US009557130B2

(12) United States Patent
Shneorson et al.

(10) Patent No.: US 9,557,130 B2
(45) Date of Patent: Jan. 31, 2017

(54) APPARATUS AND METHOD FOR IMPROVING HIT PROBABILITY OF A FIREARM

(71) Applicant: ISRAEL WEAPON INDUSTRIES (I.W.I) LTD., Ramat HaSharon (IL)

(72) Inventors: Zeev Shneorson, Raanana (IL); Naor Sagy, Tel Aviv (IL); Ran Tamir, Rehovot (IL); Evgeni Mashkevich, Ashdod (IL)

(73) Assignee: ISRAEL WEAPON INDUSTRIES (I.W.I) LTD., Ramat Hasharon (IL)

( * ) Notice: Subject to any disclaimer, the term of this patent is extended or adjusted under 35 U.S.C. 154(b) by 0 days.

(21) Appl. No.: 14/714,388

(22) Filed: May 18, 2015

(65) Prior Publication Data

US 2015/0345887 A1 Dec. 3, 2015

(30) Foreign Application Priority Data

May 27, 2014 (IL) ..... 232828

(51) Int. Cl.
*F41A 19/59* (2006.01)
*F41A 17/08* (2006.01)
(Continued)

(52) U.S. Cl.
CPC ..... *F41A 19/59* (2013.01); *F41A 17/08* (2013.01); *F41G 1/46* (2013.01); *F41J 5/10* (2013.01)

(58) Field of Classification Search
CPC ..... F41A 19/59; F41A 17/08; F41G 1/46; F41J 5/10
(Continued)

(56) References Cited

U.S. PATENT DOCUMENTS 6,886,287 B1 5/2005 Bell
7,055,276 B2 6/2006 Mcpherson
(Continued)

FOREIGN PATENT DOCUMENTS

DE 19905042 8/1999
EP 0605290 1/1997
(Continued)

OTHER PUBLICATIONS

"Tracking Point "Intelligent Digital Tracking Scopes"—The Firearm Blog," The Future Is Now: Tracking Point Precision Guided Firearms. http://www.thefirearmblog.com/blog/2012/11/22/the-future-is-now-tracking-point-precision-guided-firearms/.
(Continued)

*Primary Examiner* — Stephen M Johnson
*Assistant Examiner* — Joshua Semick
(74) *Attorney, Agent, or Firm* — Soroker Agmon Nordman

(57) ABSTRACT

The subject matter discloses a fire improving hit probability apparatus for reducing misfire of a firearm, comprising a trigger unit to detect when a trigger of the firearm is engaged; a detection unit to collect direction data of a direction at which the firearm is directed when the trigger of the firearm is engaged; a firing processor to improve accuracy of a shooter firing the firearm, wherein the firing processor designates a target sample when the firing processor receives a signal from the trigger unit that the trigger is engaged, wherein the target sample comprises the direction data; a storage for storing an orientation sample designated by the firing processor; an electromagnet to control functions of a sear of the firearm; wherein the firing processor designates a target orientation data according to orientation data collected when the trigger is engaged, said target orientation data is compared to a real time orientation
(Continued)

data; wherein the firing processor enables the firing processor the firearm to fire a round when the real time orientation data matches the target orientation data.

17 Claims, 4 Drawing Sheets

(51) Int. Cl.
*F41G 1/46* (2006.01)
*F41J 5/10* (2006.01)

(58) Field of Classification Search
USPC ..... 89/28.1
See application file for complete search history.

(56) References Cited

U.S. PATENT DOCUMENTS

| | | | | |
|---|---|---|---|---|
| 7,810,273 | B2 | 10/2010 | Koch | |
| 8,141,473 | B2 * | 3/2012 | Kude | F41G 1/38 235/403 |
| 8,496,480 | B2 | 7/2013 | Guissin | |
| 8,887,430 | B2 * | 11/2014 | Wichner | F41A 17/12 42/70.01 |
| 8,936,193 | B2 * | 1/2015 | McHale | F41G 3/12 235/417 |
| 9,091,507 | B2 * | 7/2015 | Paterson | F41G 3/06 |
| 9,110,295 | B2 * | 8/2015 | Lupher | F41A 17/06 |
| 9,222,754 | B2 * | 12/2015 | Lupher | F41G 1/38 |
| 9,250,035 | B2 * | 2/2016 | Sullivan | F41G 11/003 |
| 9,335,121 | B2 * | 5/2016 | McHale | F41G 1/473 |
| 2002/0174588 | A1 | 11/2002 | Danner | |
| 2005/0213962 | A1 | 9/2005 | Gordon | |
| 2006/0005447 | A1 * | 1/2006 | Lenner | F41G 3/06 42/111 |
| 2007/0234626 | A1 | 10/2007 | Murdock | |
| 2008/0190007 | A1 | 8/2008 | Page et al. | |
| 2011/0126622 | A1 | 6/2011 | Turner et al. | |
| 2012/0097741 | A1 | 4/2012 | Karcher | |
| 2012/0297658 | A1 | 11/2012 | Lupher et al. | |

FOREIGN PATENT DOCUMENTS

| | | |
|---|---|---|
| EP | 2536995 | 12/2012 |
| IL | 211966 | 11/2011 |
| JP | 2001/021291 | 1/2001 |
| WO | 2011/102894 | 8/2011 |
| WO | 2012/131548 | 11/2012 |

OTHER PUBLICATIONS

Gizmag.com article "TrackingPoint precision guided rifles decide when to take their own best shot" http://www.gizmag.com/trackingpoint-precision-guided-firearms-scopes-digital/25264/
Video link: http://youtu.be/LvbyAcYjzlc.

* cited by examiner

APPARATUS AND METHOD FOR IMPROVING HIT PROBABILITY OF A FIREARM

FIELD OF THE INVENTION

The subject matter relates generally to an apparatus and method for improving hit probability of a user of a firearm, improve the user's control of the weapon, and maintaining fire for longer periods.

BACKGROUND OF THE INVENTION

Using a firearm requires skill and practice. A user of a firearm has to be in control of the firearm to ensure that rounds fired are fired at a desired target. In some of the situations, the goal of firing a round is not to hit a desired target, but rather to cause an opponent to seek cover or to prevent return fire. Users of firearms, in such situations, would typically be under significant stress. Therefore, there is a high chance that the user of the firearm will shoot in a wrong direction due to fear, anxiety, or the like. After firing the round, it takes the user of the firearm a relatively long time to reposition the firearm so as to be aimed at a target and to release another round in the direction of the first round.

Modern firearms, such as machine guns, are typically designed to have at least two modes of firing: single round and automatic. The single round mode is also referred to as semi-automatic mode. Users of firearm in combat or like situations commonly have the firearm set to single round and more rarely to automatic. When additional firepower is required, users of the firearm may switch the firearm to automatic mode or would use semi-automatic mode to fire rapidly producing a rapid-fire effect. Users lacking experience may misfire and continue pressing a firearm trigger, leading to a waste of ammunition and increasing a risk of collateral damage.

SUMMARY

It is an object of the subject matter to disclose a fire improving hit probability apparatus for reducing misfire of a firearm, comprising a trigger unit to detect when a trigger of the firearm is engaged; a detection unit to collect direction data of a direction at which the firearm is directed when the trigger of the firearm is engaged; a firing processor to improve accuracy of a shooter firing the firearm, wherein the firing processor designates a target sample when the firing processor receives a signal from the trigger unit that the trigger is engaged, wherein the target sample comprises the direction data; a storage for storing an orientation sample designated by the firing processor; an electromagnet to control functions of a sear of the firearm; wherein the firing processor designates a target orientation data according to orientation data collected when the trigger is engaged, said target orientation data is compared to a real time orientation data; wherein the firing processor enables the firing processor the firearm to fire a round when the real time orientation data matches the target orientation data.

In some cases the firing processor determines a center of mass according to the orientation data collected prior to engagement of the trigger, said center of mass is an algorithmic determination of an orientation direction in which a user of the firearm was aiming the firearm prior to engaging the trigger to fire a first round.

In some cases, the detection unit comprises a mechanical micro system unit that measures the orientation data; wherein the firing processor designates an orientation sample as the target sample; wherein the orientation sample comprises the orientation data; wherein the firing processor compares the orientation sample with the real time orientation data measured by a mechanical micro system unit.

In some cases, the firing processor designates a target window in which the firearm discharges the round.

In some cases, the firing processor designates a passing zone.

In some cases, the detection unit comprises an image capturing unit, to collects image data; wherein the firing processor designates an image sample as the target sample; wherein the image sample is compared to a new image data collected by the image capturing unit.

In some cases, the fire improving hit probability apparatus further comprising a transceiver to transmit data to a computerized device, a mobile device, a server, or a combination thereof.

In some cases, the firing processor resets the fire improving hit probability apparatus when the trigger is disengaged.

In some cases, the electromagnet is a normally open electromagnet.

In some cases, the electromagnet is a normally closed electromagnet.

In some cases, the electromagnet is replaced by a mechanical motor.

In some cases, the electromagnet is replaced by a solenoid.

Another objective of the subject matter is to disclose a method for improving hit probability of a firearm, comprising detecting an engagement of a trigger; wherein the engagement is detected by a trigger unit of a fire improving hit probability apparatus; designating a target sample from a detection unit; wherein the target sample is direction data collected by the detection unit; wherein a firing processor designates the target sample when a firing processor receives a signal from the trigger unit that the trigger was engaged; storing the target sample in a storage; comparing the target sample with new direction data; wherein the new direction data is received from the detection unit; enabling the firing of the firearm when the target sample matches the new direction data inside a passing zone.

In some cases, the method further comprises calculating a target orientation data, wherein a center of mass is designated to the target orientation data, said center of mass is the target sample stored in the storage of the fire improving hit probability apparatus at some predetermined time prior to the engagement of the trigger and detection of the firing of a first round.

In some cases, the method further comprises designating the passing zone of the orientation data within a predetermined range, said passing zone enables the firearm to discharge the predetermined range.

In some cases, the method further comprises resetting the fire improving hit probability apparatus.

In some cases, the fire improving hit probability apparatus is reset when the trigger is disengaged.

In some cases, the fire improving hit probability apparatus is reset when a predetermined number of rounds have been discharged from the firearm.

In some cases, the fire improving hit probability apparatus is reset after a predetermined waiting time has lapsed.

In some cases, the method further comprises designating a firing safety boundary according to the target sample.

BRIEF DESCRIPTION OF THE DRAWINGS

Exemplary non-limited embodiments of the disclosed subject matter will be described, with reference to the following description of the embodiments, in conjunction with the figures. The figures are generally not shown to scale and any sizes are only meant to be exemplary and not necessarily limiting. Corresponding or like elements are optionally designated by the same numerals or letters.

DETAILED DESCRIPTION

The subject matter relates generally to a method and apparatus for reducing misfire of a firearm, improve the user's control of the weapon, and maintaining fire for longer periods, according to exemplary embodiments of the subject matter.

Figure 1A:
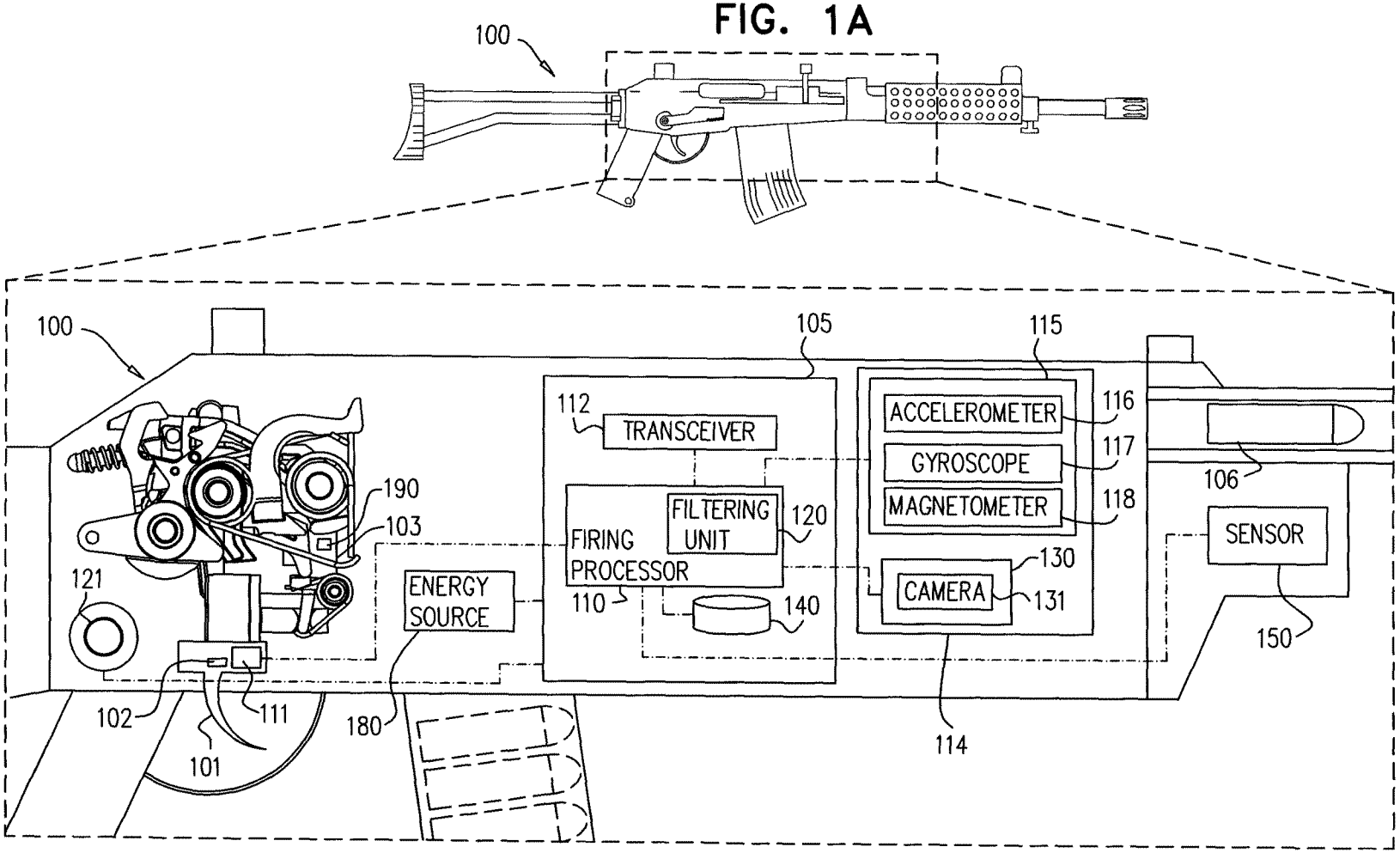
FIGS. 1A-1B show a firearm with a firing control apparatus for improving hit probability of user firing the firearm, according to some exemplary embodiments of the subject matter.

FIG. 1A shows a firearm with a fire improving hit probability apparatus for reducing misfire of the firearm, according to some exemplary embodiments of the subject matter. The firearm 100 comprises a trigger 101, which enables firing of the firearm 100. The trigger 101 engages a sear box 103. The sear box 103 controls a rate of firing the firearm 100. For example, the sear box 103 comprises a sear sensor 190 which is connected to the fire improving hit probability apparatus to monitor a sear movement of the sear box 103. The user of the firearm 100 selects which sear of the one or more sears controls a rate of firing of the firearm 100 according to how the user wishes to use the firearm 100. The fire improving hit probability apparatus 105 is connected to an interior or an exterior of the firearm 100, or may be constructed as a part of the firearm 100. The fire improving hit probability apparatus 105 comprises a trigger sensor 102, which is connected to the trigger 101. The trigger sensor 102 detects when the trigger 101 is engaged, for example, when a user of the firearm 100 presses the trigger 101. In some cases, the trigger sensor 102 comprises a magnetic sensor that senses the location of the trigger 101 according to a small magnet (not shown) connected to trigger 101 near the trigger sensor 102. In some cases, the small magnet is connected to components of a trigger mechanism (not shown) the sear box 103. The trigger sensor 102 measures the magnetic field of the magnet connected to the trigger 101 and determines the location of the trigger according to the values measured by the trigger sensor 102. A user of the firearm 100 engages the trigger 101 discharge a first round. After the first round is discharged, the fire improving hit probability apparatus 105 controls discharge of additional rounds until an end of firing condition occurs and the trigger 101 is no longer engaged. When the end of firing condition occurs and the trigger 101 is released the fire improving hit probability apparatus 105 resets. For example, the fire improving hit probability apparatus 105 receives a signal that the trigger sensor 102 no longer detects the trigger 101 is engaged, or that a predetermined number of rounds have been discharged from the firearm 100 after the first round.

When the trigger sensor 102 detects the trigger 101 is engaged, the trigger sensor 102 transfers a command to the fire improving hit probability apparatus 105 to obtain a direction data from a detection unit 114. The detection unit 114 comprises a microelectromechanical system ("MEMS") unit 115, which collects direction data. The direction data comprises of a direction at which the firearm 100 is directed. The MEMS unit 115 comprises an accelerometer 116, a gyroscope 117, a magnetometer 118 or a combination thereof to measure the direction data of the firearm 100. The accelerometer 116 is configured to measure an acceleration of a movement of the firearm, for example at a rate smaller than 400 hertz. The gyroscope 117 is configured to measure an angular velocity of the firearm, for example at a rate smaller than 760 hertz. The magnetometer 118 is configured to measure a direction of a magnetic field of the planet and where a barrel of the firearm 100 is relative to a magnetic north direction, for example at a rate smaller than 80 hertz. The MEMS unit 115 receives the information from the accelerometer 116, the gyroscope 117, the magnetometer 118 or the combination thereof and generates the direction data of the firearm 100. The direction data may be represented as a yaw, roll, and pitch of the firearm 100 at the time the first round is discharged. Such time may be the time the user presses the trigger 101 or a time substantially similar thereto. When the trigger sensor 102 detects that the trigger 101 is engaged, the trigger sensor 102 transfer a signal to the fire improving hit probability apparatus 105. The fire improving hit probability apparatus 105 records the direction data being measured by the MEMS unit 115 at the time the signal is received by the fire improving hit probability apparatus 105 and designates the direction data as a vector value. The fire improving hit probability apparatus 105 may comprise a storage 140 to store the vector value for the duration of time the vector value is required by the fire improving hit probability apparatus 105. In some exemplary embodiments of the subject matter, the fire improving hit probability apparatus 105 is connected to a firing sensor 150, which is connected to the firearm 100. The firing sensor 150 detects when the firing a round from the firearm 100 has occurred by measuring the impact caused by the firing of the round. For example, the firing sensor is a piezoelectric sensor. In such cases, the fire improving hit probability apparatus 105 may require two separate conditions for designating the target direction data. A first condition is detection by the trigger sensor 102 that the trigger 101 is engaged and a second condition is detection by the firing sensor 150 that a firing impact occurred to the firearm 100.

The fire improving hit probability apparatus 105 comprises a firing processor 110, which receives the direction data from the MEMs unit 115 and transfers the direction data to the storage 140 for storage. The firing processor 110 comprises a filtering unit 120, which filters the direction data and removes noise and other unwanted interferences. The filtering unit 120 comprises a direction algorithm, which may fuse data from various sensors, for example fusing data from the accelerometer 116 and the magnetometer 118. In some cases, the user's accuracy may be improved by the fire improving hit probability apparatus 105 by referencing the firing of later rounds. The referencing may be determined by a separate algorithm stored in the fire improving hit probability apparatus 105, which tracks barrel direction of the firearm 100 to generate a plot of approximate solution for optimal and correct direction. The plot may then be displayed on a display (not shown), for example where the firearm 100 comprises a scope (not shown), the plot may be displayed in through the scope. When the fire improving hit probability apparatus 105 receives a signal to designate the vector value, the firing processor 110 obtains the direction data from the storage 140. The firing processor 110 designates the direction data obtained from the storage 140 as the vector value. The firing processor 110 compares the vector value with real time direction data to determine when the real time direction data matches the vector value. When firing processor 110 matches the real time direction data matches the vector value, the fire improving hit probability apparatus 105 enables firing of the firearm 100.

In some exemplary embodiments of the subject matter the detection unit 114 comprises an image capturing unit 130 to capture imaging data, which is used as the direction data. The image capturing unit 130 comprises a camera 131, which collects images of the direction at which the firearm 100 is directed. For example, where the firearm 100 is aimed in the direction of a target, the camera 131 records images of the target as a single or additional reference of the direction, the firearm 100 is directed in. Where the firearm 100 is aimed in the direction of a building, the camera 131 collects images of the building as the reference of the direction the firearm 100 is directed. When the trigger unit 111 detects the trigger 101 is engaged, the trigger unit 111 transfers the signal to the firing processor 110 to obtain an image sample from the image capturing unit 130. The image sample may comprise an entire image collected by the image capturing unit 130 or a portion of the entire image, such as a predetermined number of pixels of the image. For example, the firing processor 110 designates as the image sample 400 pixels from the top left of the image. The image sample is stored in the storage 140 and used to compare with new image data being captured by the image capturing unit 130 on a continuous basis, or on a periodical basis, for example at a rate of 50 Hertz. When the firing processor 110 matches image sample with image data collected by the image capturing unit 130 the firing processor 110 engages a sear in the sear unit 103 to release the hammer 193 and fire a second round, such as the round 106.

In some exemplary embodiments of the subject matter, the fire improving hit probability apparatus 105 comprises a second trigger 121, for example as a push button. The user engages the trigger 101 and the second trigger 121 to enable the firearm to fire the round. In some exemplary embodiments of the subject matter, the fire improving hit probability apparatus 105 comprises a transceiver 112, which is used to transmit the data, for example for storage in a server (not shown). In some case, the transceiver 112 is used to receive commands regarding the performance of the fire improving hit probability apparatus 105, for example to remotely turn on or off the fire improving hit probability apparatus 105.

Figure 1B:
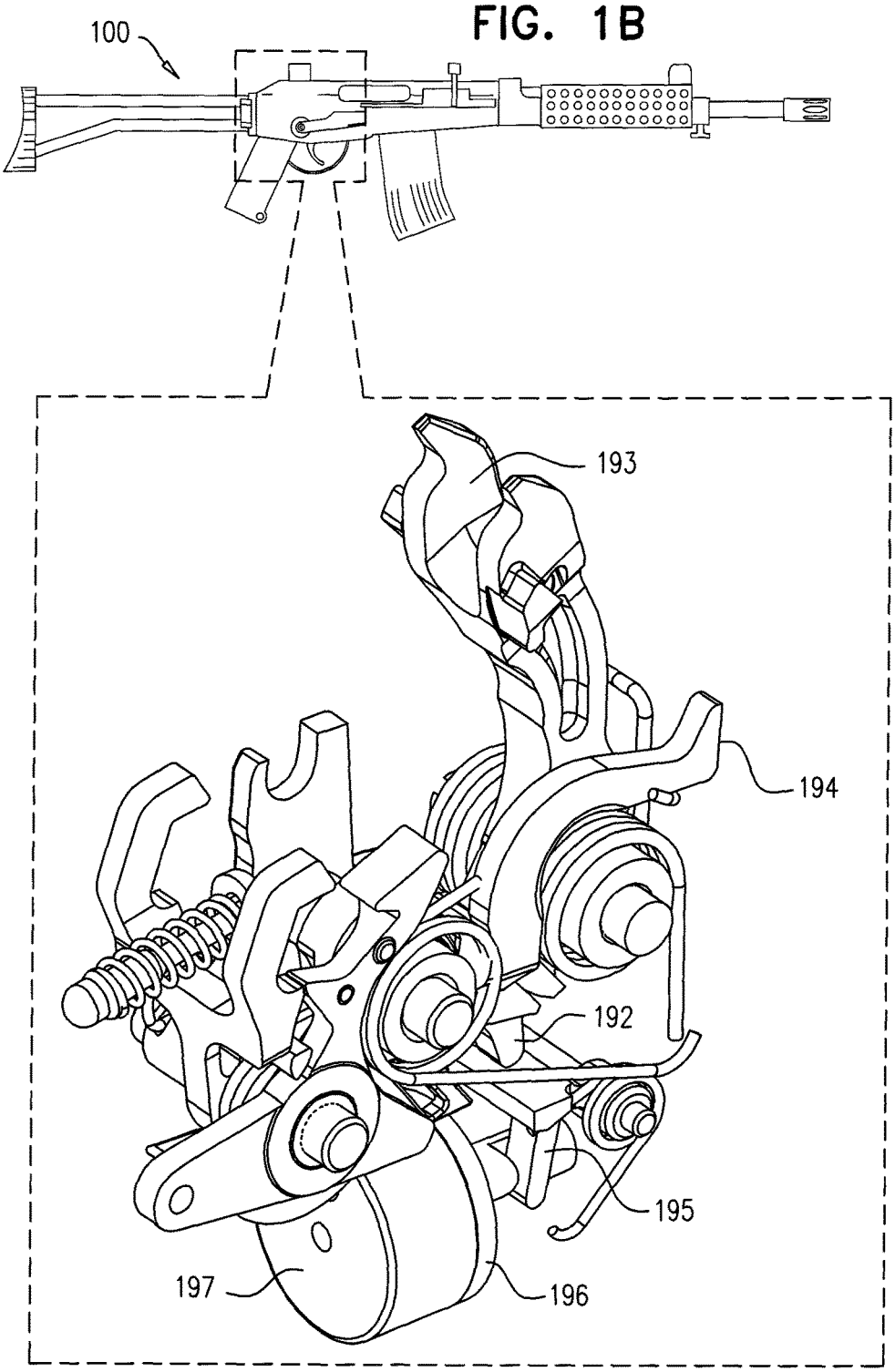

FIG. 1B shows a firing mechanism of the firearm 100 comprising the fire improving hit probability apparatus 105, according to some exemplary embodiments of the subject matter. The fire improving hit probability apparatus 105 comprises an electromagnet 197 connected to a sear 192 in the sear box 103. The electromagnet 197 controls the functions of the sear 192 when the fire improving hit probability apparatus 105 is activated and relays information to the firing processor 110, which controls the sear 192 by the methods disclosed herein. When the fire improving hit probability apparatus 105 is not activated, the firearm 100 fires every time the shooter engages the trigger 101. Where the fire improving hit probability apparatus 105 is activated, an electromagnet 197 controls the sear 192 and the firearm 100 only fires when the fire improving hit probability apparatus 105 enables firing. The electromagnet 197 is connected to a Paramagnetic sear 196, which controls a lever 195. The electromagnet 197 may be configured as a normally open electromagnet or a normally closed electromagnet. The lever 195 enables or disables the sear 192 from releasing the hammer. The electromagnet 197 controls the Paramagnetic sear 196. When the fire improving hit probability apparatus 105 sends a firing signal to the electromagnet 197, the electromagnet 197 releases the Paramagnetic sear 196 and allows the sear 192 to release the hammer 193, which results in firing of the round 106. An assistance safety sear 194 enables firing the firearm 100 in a standard automatic manner when the fire improving hit probability apparatus 105 is disabled. In some cases, an assistance safety sear 194 enables firing of the firearm 100 when the fire improving hit probability apparatus 105 is disabled. The assistance safety sear 194 may enable automatic firing of the firearm 100.

Figure 2:
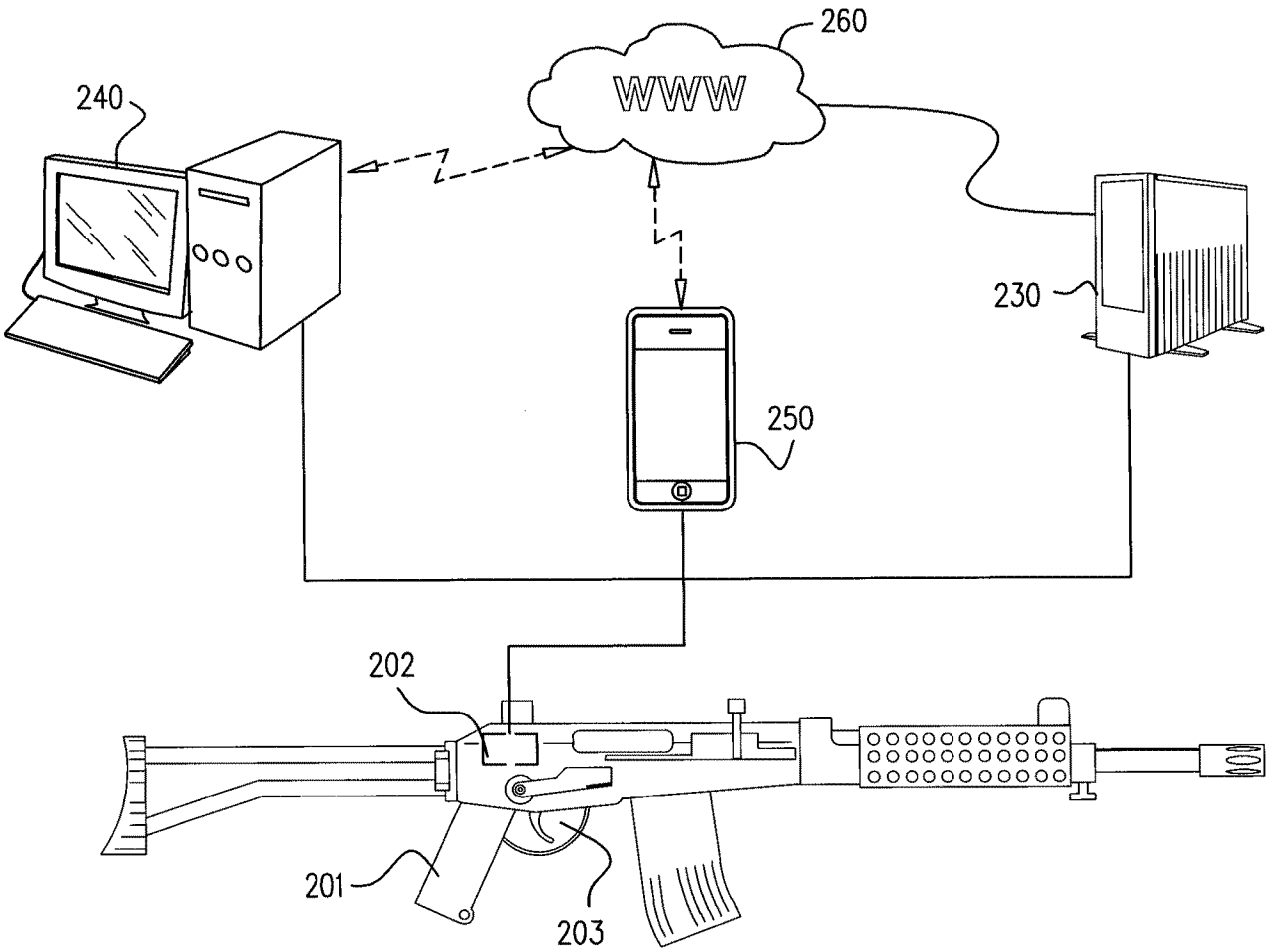
FIG. 2 shows an environment of a firearm with a fire improving hit probability apparatus, according to some exemplary embodiments of the subject matter; and, FIG. 3 shows a method performed by a fire improving hit probability apparatus to improve a hitting probability of a user of a firearm, according to some exemplary embodiments of the subject matter.

FIG. 2 shows an environment of a firearm with a fire improving hit probability apparatus, according to some exemplary embodiments of the subject matter. The environment 200 comprises the firearm 201. The firearm 201 comprises a fire improving hit probability apparatus 202, which improves hit probability of the firearm 201. The fire improving hit probability apparatus 202 may be attached to the exterior or interior of the firearm 201. In some cases the fire improving hit probability apparatus 202 is constructed as part of the firearm 201. The fire improving hit probability apparatus 202 collects direction data of a direction in which the firearm 100 is directed. When a user of the firearm 201 engages a trigger 203, the fire improving hit probability apparatus 202 designates the vector value as the direction data collected by the fire improving hit probability apparatus 202 at the time the trigger 203 is pressed. While the trigger 203 remains engaged, the fire improving hit probability apparatus 202 prevents the firearm 201 from discharging a round unless new direction data collected matches the vector value. The fire improving hit probability apparatus 202 compares between direction data collected and the vector value. When the new direction data matches the vector value, the fire improving hit probability apparatus 202 enables the firearm 201 to discharge the round. The fire improving hit probability apparatus 202 may designate a firing safety boundary around the vector value. The firing safety boundary is a deviation area around the vector value in which the fire improving hit probability apparatus 202 may enable the firearm 201 to discharge the round. When the firearm 201 is aimed outside of the firing boundaries, the fire improving hit probability apparatus 202 prevents the firearm 100 from firing. In some exemplary embodiments of the subject matter, the firing safety boundary may be modified prior to use of the firearm 100, for example according to which user is firing the firearm 100 or whether the task is for different combat engagements.

In some exemplary embodiments of the subject matter, the user of the firearm, due to stress, inexperience, or the like, may move the firearm 201 from a desired firing direction when pressing the trigger 203. The fire improving hit probability apparatus 202 analyzes direction data collected prior to the shooter engaging the trigger, for example the 300 milliseconds prior to the shooter pressing the trigger 203, and designate the vector value to be the direction data collected before pressing the trigger for the first round fired.

In some exemplary embodiments of the subject matter, the fire improving hit probability apparatus 202 transmits firing data to a computerized device 240 or a mobile device 250, such as a tablet or smartphone. The firing data may comprise, the number of rounds discharged from the firearm 201 at a designated direction, the length of time required by the shooter to realign the firearm 201 in the designated direction, or the like. The firing data may enable a third party to monitor firing patterns of the shooter firing the firearm 201 and provide instructive assistance and training to the shooter to improve reaction time and firing performance. The fire improving hit probability apparatus 202 may communicate with the computerized device 240 or a mobile device 250 through near field communication, Bluetooth, or the like. The third party may then provide instruction to the user of the firearm on how to improve the use of the firearm 201. In some cases, the fire improving hit probability apparatus 202 may transmit the firing data to a server 230, to enable storing the firing data and providing access to the firing data at a later time. The server 230 may be accessed by the computerized device 240 or the mobile device 250 a World Wide Web ("WWW") 260 and enables sharing of the firing data through a website on the WWW 260, a file sharing protocol ("FTP"), or the like.

Figure 3:
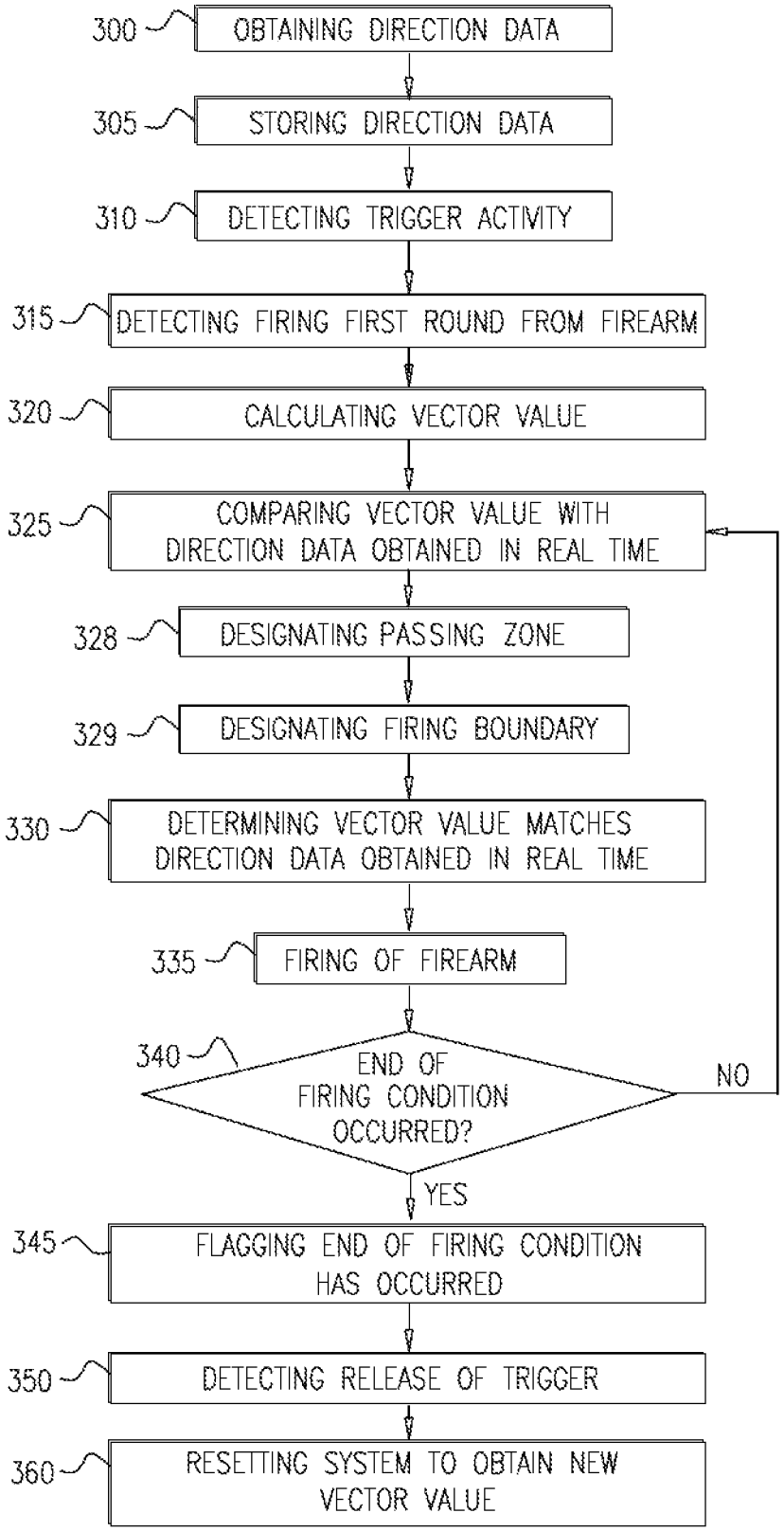

FIG. 3 shows a method performed by a fire improving hit probability apparatus to improve a hitting probability of a user of a firearm, according to some exemplary embodiments of the subject matter. Step 300 discloses the fire improving hit probability apparatus 105 of FIG. 1 obtaining direction data. The detection unit 114 of FIG. 1 obtains direction data. In some exemplary embodiments of the subject matter, the detection unit 114 comprises the MEMs unit 115 of FIG. 1, which comprises the accelerometer 116 of FIG. 1, the gyroscope 117 of FIG. 1, the magnetometer 118 of FIG. 1 or a combination thereof. The MEMs unit 115 obtains the direction data as values of pitch, roll and yawl, as is further described herein above in connection with the description of the other figures. In some exemplary embodiments of the subject matter, the direction data is obtained in the form of image data, which is recorded by the image capturing unit 130 of FIG. 1. The detection unit 114 transfers the direction data to the fire improving hit probability apparatus 105 as the direction data is collected.

Step 305 discloses the fire improving hit probability apparatus 105 storing the direction data. The firing processor 110 of FIG. 1 transfers the direction data to the storage 140 of FIG. 1 to be stored. In some cases, the direction data is stored for a predetermined amount of time, after which time the direction data is deleted from the storage 140 to preserve space in the storage 140 for later use. For example, the firing processor 110 deletes stored direction data from the storage every 1-5 seconds.

Step 310 discloses the fire improving hit probability apparatus 105 detecting a trigger activity. The trigger sensor 102 of FIG. 1 detects when the trigger 101 of FIG. 1 is engaged by the user of the firearm 100. When the trigger sensor 102 detects the trigger 101 is engaged, the trigger sensor 102 sends a signal to the firing processor 110 to inform the firing processor 110 that the trigger 101 is engaged. In some non-limiting cases, the trigger sensor 102 comprises a magnetic sensor that measures the strength of a magnetic field created by the movement of the trigger 101 to the trigger sensor 102. In such cases, a magnet is embedded in the trigger 101 such that the magnet's motion creates a change in the magnetic field measured by the trigger sensor 102. For example, when the trigger 101 is engaged, the trigger sensor 102 measures a rise in the magnetic field which signals that the trigger 101 is engaged, and a decrease in the magnetic field signals the trigger 101 is released.

Step 315 discloses the fire improving hit probability apparatus 105 detecting a firing of a first round from the firearm 100. When the trigger 101 is engaged by the user, the firearm 100 fires the first round. The fire improving hit probability apparatus 105 comprises the firing sensor 150 of FIG. 1, which detects when a round is fired from the firearm 100. The firing sensor 150, which in some cases is a piezoelectric sensor, measures the impact to the firearm 100 to confirm that the round was fired. When the user of the firearm 100 engages the trigger 101 the firearm 100 fires the first round in a direction that the user aimed the firearm 100. The firing sensor 150 detects the firing of the first round. In some exemplary cases, the firing sensor 150 is connected to a hammer of the firearm 100 to detect the motion of the hammer to enable determining a firing of the firearm 100 occurred.

Step 320 discloses the fire improving hit probability apparatus 105 calculating a vector value. After the firing processor 110 is informed by the trigger sensor 102 that the trigger 101 is engaged the firing processor 110 calculates the vector value. The vector value comprises direction data the fire improving hit probability apparatus uses to determine when the firearm 100 is aimed at in a desired direction to enable firing of the firearm 100. In some cases, the firing processor 110 calculates the vector value when the firing sensor 150 detects the first round is fired. In other cases, the firing processor 110 must receive be informed by the trigger sensor 102 that the trigger 101 is engaged and that the firing sensor 150 detected the firing of the first round before calculating the vector value. In some exemplary embodiments of the subject matter, the trigger sensor 102 may detect the motion of the trigger 101 such that different signals are sent to the firing processor 110 according to the location of the trigger 101. For example, when the trigger 101 is half engaged the trigger sensor 102 transmits a first signal where the firing processor 110 obtains the vector value without discharging the first round. When the trigger 101 is then fully engaged the firearm 100 does not discharge the first round until the firing processor 110 enables firing of the first round. In some cases, the firing processor 110 designates direction data obtained when the first round is fired as the vector value.

In some exemplary embodiments of the subject matter, the calculation comprises assigning an array of values to designate a target window surrounding the vector value. Where the firing processor 110 designates the target window, the firing processor enables firing of the firearm when real time direction data matches any value of the array. In some cases, the target window may comprise a different array size according to the type of firearm 100 being fired, the experience of the user, and the like.

In some exemplary embodiments of the subject matter, the firing processor 110 calculates a central direction point according to the direction data collected by the detection unit 114. The central direction point is an algorithmic determination of a direction in which a user of the firearm was aiming the firearm prior to engaging the trigger to fire a first round. In some cases, the user of the firearm 100 is not well trained in firing the firearm 100 and may miss a target due to inexperience, stress, a distraction, or the like. In such cases, the firing processor 110 designates the central direction point as the vector value, which is direction data stored in the storage 140 at some predetermined time prior to engagement of the trigger 101 and detection of the firing of the first round. For example, the firing processor 110 designates the vector value as the direction data collected by the detection unit 114 fifty milliseconds prior to detection of engagement of the trigger 101 and firing of the first round. Designation of direction data from some predetermined time as the vector value provides for a more accurate vector value due to a higher likelihood the user had a better aim prior to engaging the trigger 101.

In some exemplary embodiments of the subject matter, the firing processor 110 designates the central direction point according to direction data obtained over a predetermined time range occurring some predetermined time prior to detection of engagement of the trigger 101 and of firing of the first round. For example, the firing processor 110 analyzes the direction data of a one second period prior to detection of trigger engagement and firing of the first round. The firing processor 110 analyzes the direction data stored in the storage 140 to determine the direction data that is most collected in the time period prior to detection of the trigger engagement and firing of the first round.

Step 325 discloses the fire improving hit probability apparatus 105 comparing the vector value with real time direction data. After the firing processor 110 designates the vector value, the firing processor 110 compares the direction data of the vector value with direction data obtained in real time, while the user is aiming the firearm 100. In cases where the direction data comprises data obtained by the MEMs unit 115, the firing processor 110 compares the pitch, role, and yawl, of the vector value is compared to the pitch, role, and yawl of the direction data obtained in real time. In cases where the direction data comprises data obtained by the image capturing unit 130, the firing processor 110 may compare pixels from the vector value with pixels from the direction data obtained in real time.

Step 328 discloses the fire improving hit probability apparatus 105 designating a passing zone. In some exemplary embodiments of the subject matter, the comparison is performed for the passing zone, which comprises direction data within a predetermined range in which the fire improving hit probability apparatus 105 enables firing of the firearm 100. Designating the passing zone creates compromise between accuracy and speed of firing of the fire improving hit probability apparatus 105. The firing processor 110 designates the passing zone according a predetermined range, for example, the passing zone comprising an area of a circle with a 10 mili-radian.

Step 329 discloses the fire improving hit probability apparatus 105 designating a firing safety boundary. The firing processor 110 designates the firing safety boundary as a predetermined distance from the vector value. When the detection unit 114 collects direction data that is greater than the firing safety boundary, the firing processor 110 stops firing and the user of the firearm 100 must release the trigger and designate a new vector value. For example the firing safety boundary is where the firearm 100 is aimed 10 degrees relative to any direction away from the vector value.

Step 330 discloses the fire improving hit probability apparatus 105 determining the vector value matches direction data of the barrel obtained in real time. When the firing processor 110 determines that the direction data obtained in real time matches the vector value. In some exemplary embodiments of the subject matter, the firing processor 110 determines there is a match where the direction data obtained in real time is within the passing zone.

Step 335 discloses the fire improving hit probability apparatus 105 firing the firearm 100. The firing processor 110 sends a signal to the electromagnet 197 of FIG. 1B to release the Paramagnetic sear 196 of FIG. 1. When the Paramagnetic sear 196 is released, the sear 192 of FIG. 1B releases the hammer 193 of FIG. 1B. Release of the hammer 193 results in the firing of a round from the firearm 100. In some cases, the electromagnet 197 may be a replaced by a solenoid or a mechanical motor that control the hammer 193 or the sear Step 340 discloses the fire improving hit probability apparatus 105 determining whether an end of firing condition occurred. The firing processor 110 comprises a plurality of end of firing commands which prevent the firearm 100 from firing until the trigger 101 is released and the fire improving hit probability apparatus 105 resets. In some cases, the end of firing command is the firing of a predetermined number of consecutive rounds, for example, five rounds. In some cases, the end of firing command is a lapse of a predetermined waiting time in which no firing occurs. For example, where the firing processor 110 cannot match the direction data obtained in real time with the vector value for longer than 3 seconds the firing processor 110 flags the end of firing command. In other cases, the firing processor 110 flags the end of firing command where the direction data collected in real time is exceeds the value of the firing safety boundary. In all cases, when the user disengages the trigger 101, the firing processor 110 flags the end of firing command. In cases where the fire improving hit probability apparatus 105 determines that an end of firing condition did not occur, the fire improving hit probability apparatus 105 returns to step 325. In cases where the fire improving hit probability apparatus 105 determines that an end of firing condition did occur, the fire improving hit probability apparatus 105 performs step 345 of flagging an end of firing condition has occurred.

Step 350 discloses the fire improving hit probability apparatus 105 detecting a release of the trigger 101. In cases where the end of firing command is flagged prior to release of the trigger 101, the firing processor 110 waits for release of the trigger 101 to enable resetting of the fire improving hit probability apparatus 105.

Step 360 discloses the fire improving hit probability apparatus 105 resetting to obtain a new vector value. Once the end of firing condition is flagged and the trigger 101 is disengaged, the firing processor 110 resets the fire improving hit probability apparatus 105 to obtain a new vector value.

While the disclosure has been described with reference to exemplary embodiments, it will be understood by those skilled in the art that various changes may be made and equivalents may be substituted for elements thereof without departing from the scope of the subject matter. In addition, many modifications may be made to adapt a particular situation or material to the teachings without departing from the essential scope thereof. Therefore, it is intended that the disclosed subject matter not be limited to the particular embodiment disclosed as the best mode contemplated for carrying out this subject matter, but only by the claims that follow.

The invention claimed is:

1. A fire aim improving hit probability apparatus, comprising:

a trigger unit to detect when a trigger of a firearm is engaged; said engagement results in firing of a first round from the firearm, a detection unit to collect direction data of a direction at which the firearm is directed;

a firing sensor to detect a firing of a first round from the firearm;

a firing processor to improve the hit probability of a shooter firing the firearm, said firing processor configured to:

receive a detection from the trigger unit that the trigger is engaged;

calculate a vector value when the firing processor receives the detection from the trigger unit that the trigger is engaged and from the firing sensor that a first round is fired from the firearm, said vector value is calculated according to the direction data collected by the detection unit;

compare the vector value to a real time direction data;

enable firing of the firearm when the vector value matches the real time direction data;

a storage for storing the direction data obtained by the detection unit; and, an electromagnet to control functions of a sear of the firearm.

2. The fire aim improving hit probability apparatus of claim 1, wherein the firing processor is further configured to determine a central direction point, wherein the central direction point is determined according to the direction data obtained at a predetermined time prior to engagement of the trigger, and according to detection of firing of the first round.

3. The fire aim improving hit probability apparatus of claim 1, wherein the detection unit comprises a microelectmmechanical system (MEMS) unit, said MEMS unit comprising at least one of: an accelerometer, a gyroscope, a magnetometer or a combination thereof, said MEMS unit measures the real time direction data.

4. The fire aim improving hit probability apparatus of claim 1, wherein the detection unit comprises an image capturing unit, to collect image data of a direction at which the firearm is aimed; wherein the firing processor obtains an image sample of the image data as the vector value; wherein the vector value is compared to new image data collected by the image capturing unit.

5. The fire aim improving hit probability apparatus of claim 1, wherein the firing processor is further configured to reset the fire improving hit probability apparatus when the trigger is disengaged.

6. The fire aim improving hit probability apparatus of claim 1, wherein the electromagnet is a normally closed electromagnet.

7. The fire aim improving hit probability apparatus of claim 1, wherein the electromagnet is a normally open electromagnet.

8. A method performed by a fire aim improving hit probability apparatus for improving hit probability of a firearm, the method comprising:

detecting engagement of a trigger; wherein the engagement is detected by a trigger unit of a fire improving hit probability apparatus, said trigger engagement results in firing of a first round from the firearm;

detecting firing of a first round from the firearm, said firing is detected by a firing sensor of the fire improving hit probability apparatus;

calculating a vector value from direction data obtained from a detection unit of the fire aim improving hit probability apparatus, wherein a firing processor of the fire aim improving hit probability apparatus calculates the vector value when the firing processor receives the detection from the trigger unit that the trigger was engaged and the first round was fired from the firearm;

comparing, by the firing processor, the vector value with real time direction data; wherein the real time direction data is received from the detection unit;

enabling, by the firing processor, the firing of a second round from the firearm when the vector value matches the real time direction data within a passing zone; and controlling functions of a sear of the firearm using an electromagnet.

9. The method of claim 8, further comprising storing direction data used to calculate the vector value; wherein the vector value is calculated from the direction data obtained by the direction unit at a predetermined time prior to engagement of the trigger and stored in a storage of the fire aim improving hit probability apparatus said vector value is designated as a central direction point by the firing processor.

10. The method of claim 9, further comprising designating the passing zone at a predetermined area surrounding the central direction point, said passing zone enables the firearm to discharge within the predetermined area.

11. The method of claim 8, further comprising resetting the fire improving hit probability apparatus.

12. The method of claim 11, wherein the fire improving hit probability apparatus is reset when the trigger is disengaged.

13. The method of claim 11, wherein the fire improving hit probability apparatus is reset upon determining that a predetermined number of consecutive rounds have been fired from the firearm.

14. The method of claim 11, wherein the fire improving hit probability apparatus is reset upon determining that a predetermined waiting time has lapsed.

15. The method of claim 9, further comprising designating a firing safety boundary at a predetermined distance from the central direction point.

16. The apparatus of claim 1, wherein the firing processor is further configured to designate a central direction point according to the vector value, said the vector value is calculated from the direction data measured by the direction unit at a predetermined time prior to engagement of the trigger.

17. The apparatus of claim 16, wherein the firing processor is further configured to designate the passing zone of the direction data within a predetermined area, said passing zone enables the firearm to discharge a round within the predetermined area.

* * * * *